United States Patent [19]

Carbonetti

[11] Patent Number: 4,564,196

[45] Date of Patent: Jan. 14, 1986

[54] ANKLE APPLIANCE FOR PLAYING FOOTBALL

[76] Inventor: Italo Carbonetti, 11 Via Prassitele, 00125 Axa Acilia Sud (Roma), Italy

[21] Appl. No.: 517,273

[22] Filed: Jul. 26, 1983

[30] Foreign Application Priority Data

Sep. 16, 1982 [IT] Italy ..... 49129 A/82

[51] Int. Cl.[4] ..... A43B 5/00

[52] U.S. Cl. ..... 273/67 B; 273/DIG. 18; 36/133; 2/22

[58] Field of Search ..... 272/119; 273/54 R, 54 B, 273/54 AB, 67 R, 67 B, 193 R, 194 R, DIG. 18; 2/22; 128/25 R, 25 B; 36/128, 133

[56] References Cited

U.S. PATENT DOCUMENTS

| | | | |
|---|---|---|---|
| 2,220,291 | 11/1940 | Savoy | 273/67 B |
| 2,269,357 | 1/1942 | Dent | 273/67 B |
| 2,796,684 | 6/1957 | Montgomery | 36/128 |
| 3,416,062 | 12/1968 | Marvid | 2/22 |
| 3,516,668 | 1/1970 | Kirk | 273/67 B |
| 3,583,704 | 6/1971 | Callanan | 273/54 B |
| 3,650,051 | 3/1972 | Sass | 273/54 B |
| 4,042,241 | 8/1977 | Collins | 273/DIG. 18 |
| 4,306,315 | 12/1981 | Castiglia | 2/22 |
| 4,326,299 | 4/1982 | Bednar | 2/22 |
| 4,355,801 | 10/1982 | Thomsen | 272/119 |
| 4,422,249 | 12/1983 | Hannah | 36/133 |

FOREIGN PATENT DOCUMENTS

| | | | |
|---|---|---|---|
| 509276 | 7/1939 | Austria | 272/119 |
| 40441 | 7/1976 | France | 36/133 |
| 5653 | 8/1911 | United Kingdom | 273/67 B |

*Primary Examiner*—Richard J. Apley
*Assistant Examiner*—H. Macey
*Attorney, Agent, or Firm*—Browdy and Neimark

[57] ABSTRACT

An appliance to be applied to the ankle of one or both legs of a soccer-style kicker to improve the trajectory of the kicked ball, involving a relatively rigid cordon-like member, with an arched shape so as to surround the front part of the ankle and with the ends curved down and forward so as to partially surround the back side of the malleoli (FIG. 2).

3 Claims, 7 Drawing Figures

ANKLE APPLIANCE FOR PLAYING FOOTBALL

BACKGROUND OF THE INVENTION

The present invention refers to a ballistic ankle appliance for soccer-style kicking. For example, in the game of soccer, players and fans know that the number of goals in a match has always since the game, began been low or even zero. For example, in the game of soccer, discrepancy was again confirmed in the World Cup in Spain in 1982.

The modern game with new tactics has led to substantial modifications to the schemes for improved penetration of the opponent's defense. However, these expedients do not resolve the problem of low scoring. The spectators would prefer to see many goals, and are unsatisfied by matches with final scores of 0-0.

Of course, many shots miss due to reasons still not clearly understood. These reasons include causes other than the shooters inability, since even the most famous players commit errors as well.

The missing of shots due to causes other than a player's inability is a problem of prime importance which must be solved. It is insufficient for millions of paying customers to watch a soccer match with a good center field game and rousing rushes to goal, only to see the shots go off target.

The need to score more goals in order to have a more attractive game requires means to overcome this problem, arising from natural causes, with simple and effective devices.

SUMMARY OF THE INVENTION

One of the prime causes of the imprecision of the goal shots is due to the anatomic conformation of the human locomotion apparatus, precisely the part which essentially effects the shot.

An object of the present invention is thus to provide an ankle appliance capable of lessening the risk of deviations in the ball's trajectory due to the particular anatomic conformation of the foot-leg complex in making the shot.

A further object of this invention is to provide an ankle appliance which allows shots to be made with less physical force, but with improved effectiveness.

These and other objects are achieved by the present invention, which is a support member of web material adapted to be wrapped about an ankle and secured under the sole of the foot attached to said ankle, the support member, when wrapped and secured, being continuous band wrapped about the ankle, with a downwardly arched section extending across opposing portions of said band and secured under the sole of the foot, a flexible, elongated-rounded member portion, having two free ends, each end having a downwardly depending hook portion, the elongated rounded member being fixed to the outer periphery of the band and encircling the front part of said ankle just above a malleoli on each side of the ankle on the top of the instep of the foot and surrounding the back side of the malleoli when the support member is secured wrapped and, the elongated-rounded member being 15–25 mm in diameter.

The support member may be made of any material which may be put on the ankle, such as socks, spats or harness.

The elongated rounded member may be made of plastic or strands, preferably with a rounded cross section and shaped like a protruding arch on the ankle.

The elongated rounded member may be fixed to the support by means of strong stitching or gluing or by means of textile or mechanical type anchoring, as long as the device is safe both for the player who wears the device and for an opponent with whom he comes into contact during the game.

According to a preferred embodiment, the support member comprises an upper strip of flexible web material having two free ends and is adapted to surround the front side of the malleoli just above the ankle area and is provided with closure means at each of the free ends of the upper strip, two side strips of fabric material each extending downwardly fixed at an upper end thereof to the upper strip and depending downwardly therefrom and each of the strips having closure means at a lower end thereof, the closure means being adapted to join under the foot, said elongated-rounded member being fixed at a central portion thereof to the upper strip so that the free ends of the elongated-rounded member are each located approximately at a point along the upper strip where the upper end of one of the side strip is fixed, each of the free ends of the elongated rounded member being fixed to the upper strip at a different point thereon, so that the hook portions surround the malleoli when said support member is wrapped and secured. A preferred type of closing device is so-called "Velcro", consisting of two complementary elements of plastic material, one consisting of very fine hooks and the other of very fine eyelets.

BRIEF DESCRIPTION OF THE DRAWINGS

The present invention will be illustrated below in the description of one of its preferred embodiments, shown in an exemplificative and nonlimiting way, with reference to the attached drawing, in which.

DESCRIPTION OF THE PREFERRED EMBODIMENT

To better understand the functioning of the present invention, the anatomical parts involved in shooting the ball and the consequent ballistic effects will be briefly described, referring first to FIGS. 3 to 7.

There are many causes of the imprecision of shots to the goal and it is impossible to describe them completely here, since it would require a long discussion of anatomy, static, barrycentric dynamic, as well as of emotional and psycho-physical conditions, not to mention the impediment of the opponent's defense.

Thus, the following is only a brief illustration.

The present analysis established that a principal cause of the shot's imprecision is due to the natural anatomic conformation of the areas known in football as the instep, which corresponds to the area including the lower quarter of the leg and the metatarsal, generally called the back of the foot.

In fact, the most famous players are those who can hit the ball with precision and power, using this particular area of the foot. The ballistic ankle appliance of the present invention assists in the proper striking of the ball with this area of the foot.

The back of the foot, in a more or less horizontal position with two arched surfaces at an angle to one another and with an inclination which rises from the front part to the rear, the leg with the front surface curved above the articulation, in a more or less vertical position, and the malleoli which protrude from the sides of the articulation form planes and reliefs differentiated from one another, which can cause the trajectory of the ball deviate many meters simply by shifting the striking point by only a few millimeters.

The discussion below is a technical analysis of a standing still shot, which is more demonstrative and simpler than a moving shot.

As a function of the angle of the striking parts of the foot and of the surface sector of the ball struck, different ballistic results are obtained.

Figure 3:
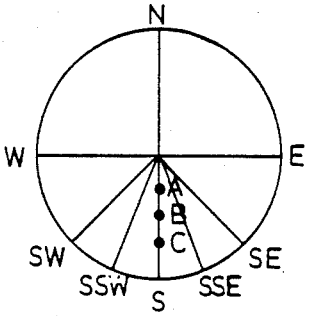
FIGS. 3 to 7 show the ballistic functioning to the invention.

With reference to FIG. 3, a ball is labelled with its cardinal point N, S, E, W, where N indicates the top. The relative position of the foot-leg is indicated in FIGS. 4–7 in three positions: 80° indicates an acute angle, 90° a right angle, and 100° an obtuse angle. This angling is approximate considering that the ball is lifted off the ground at the moment of the shot by the front part of the shoe and the back of the foot to reach the instep. For each of these positions, the ball can be struck at the height of a "parallel". FIG. 3 shows points A, B, C corresponding to three different parallels proceeding from N to S.

Figure 4:
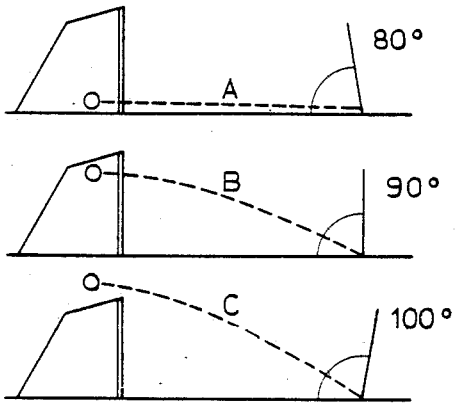

FIG. 4 shows the combined effect of the angle of the foot-leg complex and of the point of the ball struck; references A, B, C in FIG. 4 and the successive figures correspond to points A, B, C struck on the ball.

A central, corner and curve shots can vary in ballistic direction vertically and horizontally, depending on the foot-leg angle and the distance from the goal.

The goal shot is off when the ball, hitting the back of the foot with more or less force, is not counter-hit with equal intensity by the area just above the articulation. These anatomic parts, described above, being non-level, often cause the ball to slide on its axis, with consequent involuntary deviation in all directions.

Figure 5:
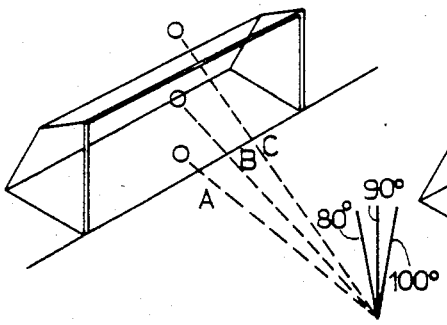
Figure 6:
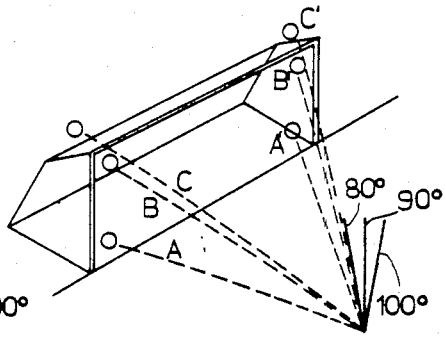
Figure 7:
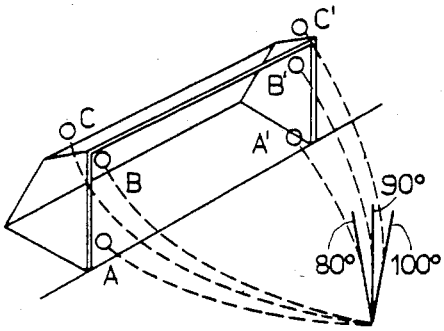

The meridians SW, SSW, SSE, SE are also shown in FIG. 3, indicating the subequatorial areas of the ball which, when hit, cause a determined ballistic trajectory. When the ball is struck in the central meridian area NS, the shot is central and "clean", that is with no curve (FIG. 5). When it is hit in the SSW and SSE meridian area, the shot in "clean", but corner (FIG. 6). When the ball is struck in the SW and SE meridian area, the shot is curved (FIG. 7). As shown in the figures, the angling of the foot-leg complex determines the elevation.

From this description, in fairly simple terms, showing only some principal factors, one can understand how difficult a goal shot is.

Figure 2:
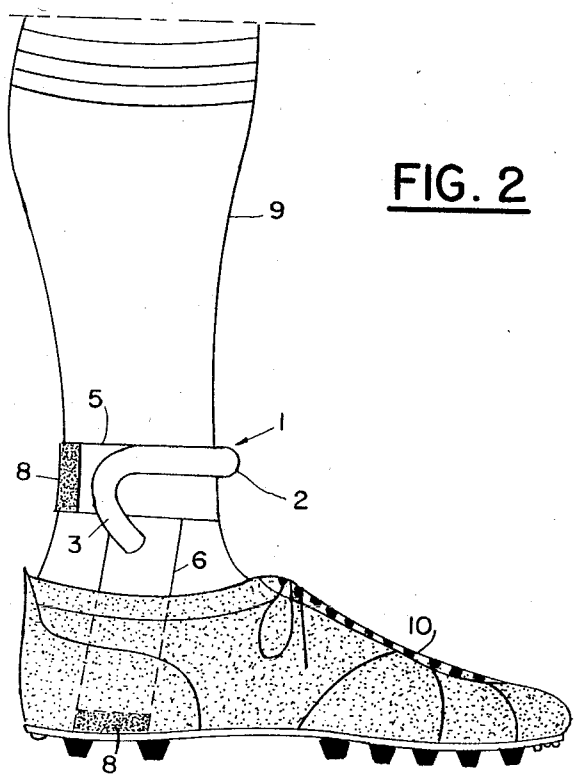
FIG. 2 is a side view of the device in FIG. 1 applied to the ankle of a soccer player.
Figure 1:
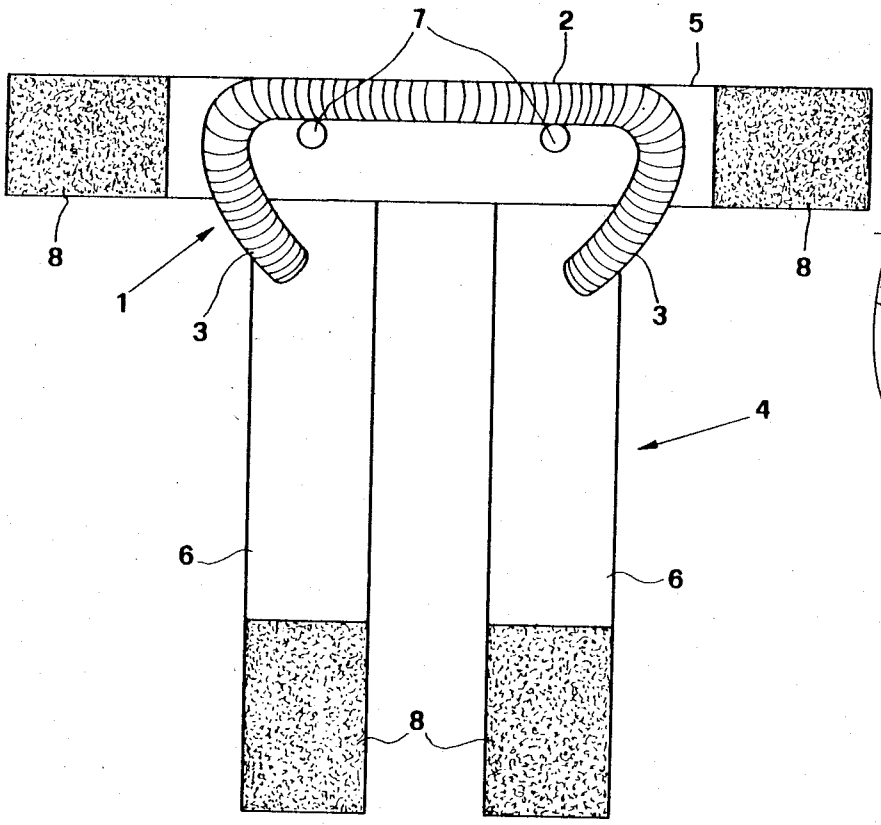
FIG. 1 is a flat view of the object.

A preferred embodiment of the present invention is described herein, with reference to FIGS. 1 and 2. The device according to the invention includes an elongated rounded member approximately 2 cm in diameter, indicated generically with 1, consisting of a single piece with one central part 2 arched to fit the curvature of the front and side part of the ankle and the two terminal parts 3 curved down and forward, so that it partially encircles the back side of the malleoli.

The member 1 is preferably made of a plastic material with a covering of suitably resistant material, preferably synthetic cloth, able to withstand, without lacerations and excessive wear and tear, the impact of the ball.

The member 1 is mounted fixed on a support element indicated generically with 4, to keep it in the desired position on the player's leg.

The support element 4 includes three strips of strong material, preferably synthetic, and more precisely a horizontal band indicated with 5, on which the cordon 1 is fixed, and two vertical side strips indicated with 6, parallel and set a predetermined distance apart, the upper ends of which are fixed to the horizontal band 5, for example by means of metal rivets 7, placed so as extend down to cover the respective malleoli when the ankle appliance is put on the ankle.

Both ends of the horizontal band 5 and the free ends of the two vertical side strips 6 have respective areas equipped with Velcro material, or fine hooks and eyelets 8. The horizontal band 5 is fixed by means of the Velcro material 8 in correspondence with the rear part of the ankle, while the free ends of the vertical strips 6 are fixed to one another below the sole of the foot.

The placement of the appliance according to the invention on one or both legs of a player is shown clearly in FIG. 2. The appliance is applied over sock 9 by joining the Velcro strips 8 in the manner described above, before the shoe 10 in put on.

The appliance according to the present invention does not injure the opponents during play, interfere with articulation or impede running. It affords considerable advantages both from a practical and functional point of view.

The cordon 1 assists in the making of a shot in all directions, since its protuberance gives a counter-shot to the ball already hit by the back of the foot.

The two curved ends 3 of the cordon 1 allow curved shots with to be achieved with a only alight torsion of the limb. The effect is an advantage for the ligaments for articulating the foot, knee and leg, since it restricts the need rotate the trunk and leg. Rotation leads, in relation to the power of the shot, to continuous microtraumas in the articulation area, which in the long term become pathological lesions.

The two vertical strips 6 of the support member 4, as well as the above-mentioned curved ends 3 of the member 1, also provide protection for the two malleoli in case of any collisions.

This invention is not limited to the embodiment described, but includes all variants.

I claim:

1. An ankle apparatus for kicking a ball comprising a support member of web material, said support member including two substantially parallel elongated strips depending downwardly from a center portion of a third elongated strip, said two elongated strips spaced and each having its longitudinal axis substantially perpendicular to the longitudinal axis of the third elongated strip, and each of the strips being provided with fastening means at the free ends thereof, thereby enabling the two substantially parallel strips to be secured under the sole of the foot and the third strip to form a continuous band around the ankle; and a flexible, semi-rigid, elongated-rounded ball contacting member, being 15–25 mm in diameter, comprising two free ends, each having a downwardly depending hook portion and a center portion therebetween, wherein the contacting member center portion is fixed to the third strip center portion substantially along the longitudinal axes thereof.

2. An appliance according to claim 1, wherein said substantially parallel strips are of synthetic textile material.

3. An appliance according to claim 2, wherein the fastening means are of the Velcro type.

* * * * *